United States Patent [19]

Yamazaki

[11] 4,121,414

[45] Oct. 24, 1978

[54] ALARM TIMEPIECE

[75] Inventor: Hiroshi Yamazaki, Tokyo, Japan

[73] Assignee: Kabushiki Kaisha Seikosha, Japan

[21] Appl. No.: 753,846

[22] Filed: Dec. 23, 1976

[30] Foreign Application Priority Data

Dec. 23, 1975 [JP] Japan ..... 50-153728
Dec. 23, 1975 [JP] Japan ..... 50-153735

[51] Int. Cl.[2] ..... G04B 23/08

[52] U.S. Cl. ..... 58/21.11; 58/21.15 S; 58/21.13; 58/19 R

[58] Field of Search ..... 58/16.5, 18, 19 R, 21.11, 58/21.13, 21.15, 21.15 S, 21.16, 57.5, 63, 73, 90 B, 106 S, 88 B

[56] References Cited

U.S. PATENT DOCUMENTS 3,783,599 1/1974 Tanaka ..... 58/16.5
3,834,153 9/1974 Yoda ..... 58/57.5
3,919,836 10/1975 Nishizawa ..... 58/106.5
4,043,115 8/1977 Bryceland ..... 58/90 B

*Primary Examiner*—Robert K. Schaefer
*Assistant Examiner*—Leonard W. Pojunas, Jr.
*Attorney, Agent, or Firm*—Robert E. Burns; Emmanuel J. Lobato; Bruce L. Adams

[57] ABSTRACT

Disclosed is an alarm timepiece having a manual switch adapted to be operated to different settings, each of the settings corresponding to one of a plurality of modes of control functions of alarm. Means are provided to detect to which mode a given setting operation of the switch corresponds and thereby to control the generation of an alarm sound. The different alarm modes include a normal alarm mode, a recurring temporal suspension of the alarm function, selective actuation of the alarm at any selected time, and termination of the alarm function.

4 Claims, 4 Drawing Figures

ALARM TIMEPIECE

BACKGROUND OF THE INVENTION

The present invention relates to an alarm timepiece and, more particularly, to an alarm timepiece having a switch capable of being operated to different settings for selecting among different alarm modes.

There have heretofore been alarm timepieces which generate a recurring acoustic alarming signal after a predetermined time has elapsed after the first alarming signal is emitted and stopped at a pre-set time. In such alarm timepieces, a switch is provided for completely dismissing or terminating the acoustic alarming mode, in addition to a switch for effecting the suspension of the acoustic alarming mode, so that there is required an increased number of parts. At the same time, this double arrangements of switches causes a confusion for the user.

SUMMARY OF THE INVENTION

It is an object of the invention to overcome the above described shortcomings of the prior art by providing an improved alarm timepiece.

According to the principal aspect of the invention, an alarm timepiece has a switch operative to provide different modes of control functions of an alarm, upon being manipulated to different settings, such as a normal alarm mode, suspension of the alarm function for a certain period of time after the stoppage of the first emitted alarming signal, and complete dismissal or termination of the alarming function. Thus, an electric circuit is employed which cooperates with the switch to provide different modes of control functions of an alarm upon receipt of corresponding derived from manual setting of the switch inputs, and to optionally actuate the alarm when desired.

It is the first object of this invention to provide an alarm timepiece in which the control functions which determine the alarming modes of operation are controlled by different setting operations of a manual switch.

It is the second object of this invention to enable generation of a repetitive acoustic alarming signal after a pre-set time has elapsed even if the acoustic alarming signal generated at a predetermined time is stopped by operation of the manual switch.

It is the third object of this invention to enable generation of an acoustic alarming as occasion demands.

It is the fourth object of this invention to provide a manual switch which generates a plurality of switching modes or settings by manual operations.

BRIEF DESCRIPTION OF THE DRAWING

The nature of the present invention as well as other objects and advantages thereof will become more apparent from consideration of the following detailed description and the accompanying drawing in which.

DESCRIPTION OF THE PREFERRED EMBODIMENTS

Figure 1:
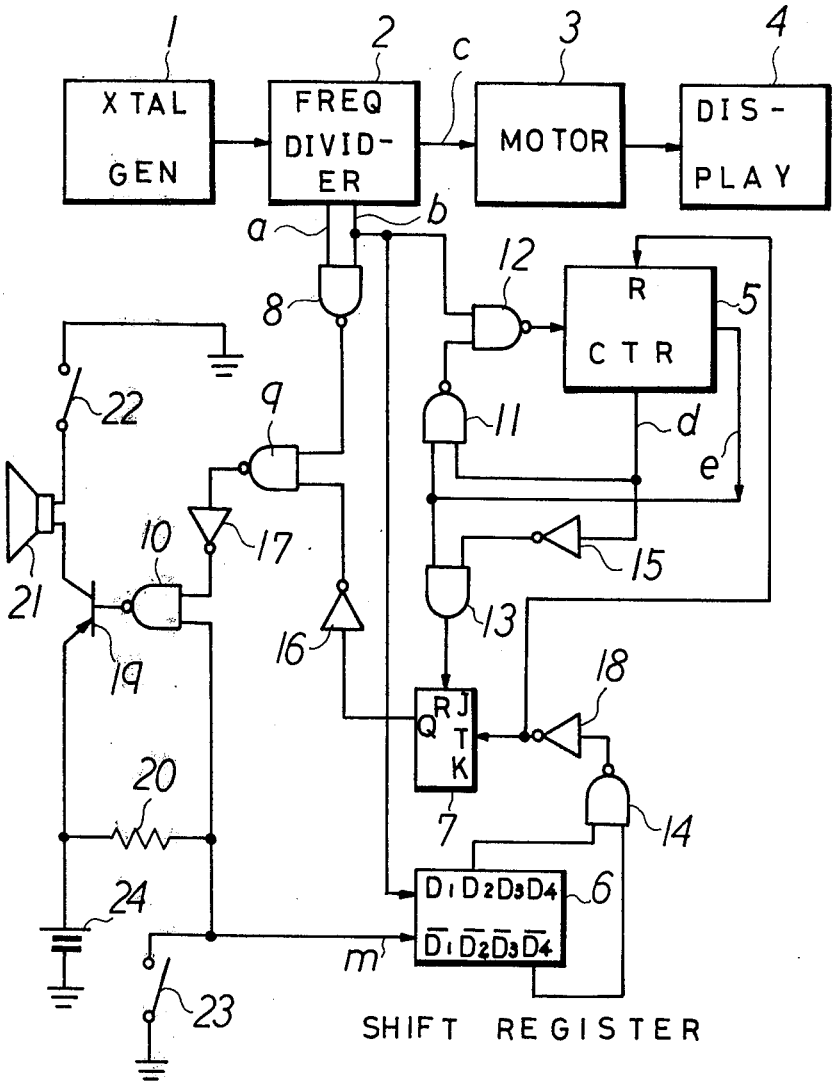
FIG. 1 shows a diagram of an electric circuit of an embodiment of the present invention.

Hereinafter, an embodiment of the invention will be described in conjunction with the attached drawings. Referring to FIG. 1, an output frequency of a quartz oscillator 1 is divided by a frequency divider 2, to produce frequency signals of several KHz and 1Hz at the terminals *a* and *b*, respectively. A motor 3 is adapted to be energized by a pulse signal of 1Hz, the rotation of which is transmitted to the hands of a clock, through a gear train, and to provide a time display at the displaying means 4. A counter 5 is adapted to generate pulses of 4Hz and 1/256Hz, respectively, at terminals *d* and *e*. A shift register having a storage capacity of 4 bits is designated by numeral 6, while a numeral 7 designates a flip-flop circuit. Reference numerals 8 to 14 and 15 to 18 denote gate circuits and inverters, respectively, while numerals 19 nd 20 denote respectively a transistor and a resistance. A speaker, a time switch and a D. C. power source are designated by numerals 21, 22 and 24, respectively. A manual switch 23 is adapted to be manipulated for setting a control mode for an alarm, and the structure of the switch is shown in FIGS. 2A and 2B.

Figure 2A:
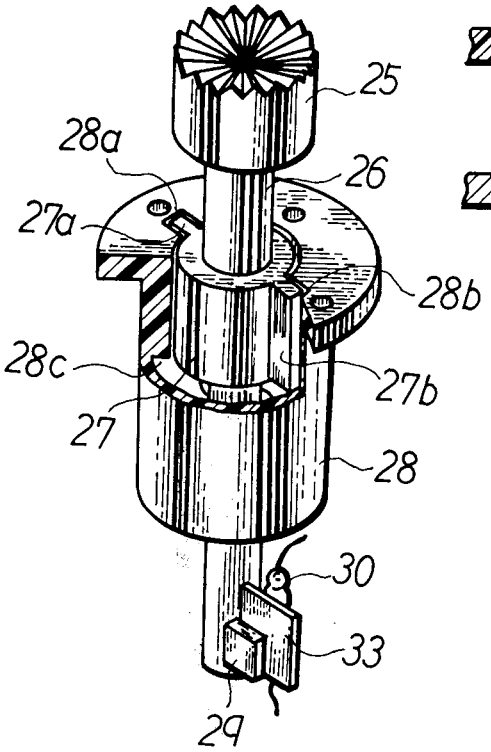
FIG. 2A is a partially sectioned perspective view of a switch adapted for cooperation of the circuit of FIG. 1.
Figure 2B:
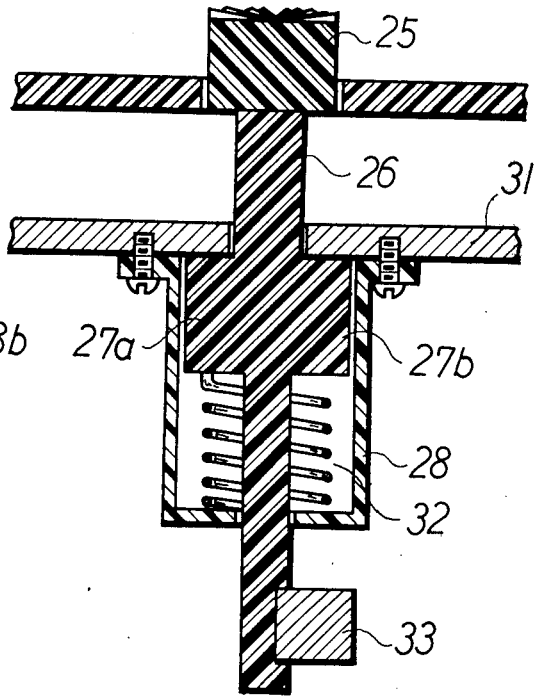
FIG. 2B is a vertical sectional view of the switch of FIG. 2A secured to an associated member.

Referring to FIGS. 2A and 2B, a shaft 26 has at its one end a push button 25, a cylindrical enlarged intermediate portion 27 and protrusions 27*a* and 27*b* formed unitarily with and projecting from the portion 27. A sleeve 28 has upper and lower portions of different wall thicknesses at the juncture of which formed is a shoulder 28*c*. Elongated slots in the form of a turned over "U" are formed in the thicker upper portion of the sleeve 28, respectively for slidably receiving protrusions 26*a* and 26*b* downwardly as viewed in FIG. 2A. The sleeve 28 is attached, at its lower and inner side, to an end of a spring 32 the other end of which is secured to the cylindrical portion 27 of the shaft 26, so that the shaft 26 is normally biased upwardly by the spring 32. The shaft 26 carries a shield plate 33 adapted to shield a lead switch 30 of FIG. 2A when the shaft 26 is at the upwardly biased position. The reference numeral 31 designates an outer frame.

In operation, a normal alarming function is performed in the following manner. At first, the time at which the acoustic alarm is to be generated is pre-set by means of an ordinary clock mechanism. Since the manual switch 23 is normally opened as shown in FIGS. 2A and 2B, the gate circuit 10 is also opened. The terminal m of the shift register 6 is kept at a theoretical signal level of "1" which is written in the shift register 6 through the pulse signal of 8Hz delivered from the terminal *b* of the frequency divider 2. Consequently, the outputs D1 to D4 of the shift registor 6 are "1," while the outputs $\overline{D1}$ to $\overline{D4}$ are "0," respectively, so that the output from the invertor 18 is "0" and the resetting of the counter 5 is released. This is because the counter 5 is adapted to be reset by an input of "1." The signal level of terminal *e* of the counter 5 remains at "0," as long as an output of 1/256 is not developed, so that the gate circuit 11 has an output of "1" thereby opening the gate circuit 12. Consequently, a pulse of 8Hz is allowed to pass from the terminal b of the frequency divider 2 to the counter 5, through the gate circuit 12. When a time interval of 256 seconds is counted by the counter 5, the signal level of terminal *e* of the counters turns to "1" so as to maintain one of the inputs to the gate circuit 13 at "1." As the counter output *e* 5 changes to "1" as described above, the output at its terminal *d* is necessarily "0" due to the phase relationship between the terminals *d* and *e*, so that the output of the invertor 15 is "1," as well as the output of the gate circuit 13, so as to reset the flip-flop circuit 7. Consequently, the level of output Q from the flip-flop circuit 7 is "0" and the output from the inverter 16 is "1," respectively, thereby opening the gate circuit 9. The frequency outputs at the terminals *a* and *b* of the frequency divider 2 are applied, through the gate circuits 9 and 10, to the base of the transistor 19. Accordingly, at the pre-set time, the speaker 21 generates an acoustic alarming signal, in response to the closure of the time switch 22.

For suspending the alarming mode of operation for a while, the push button 25 of FIGS. 2A and 2B is depressed to close the manual switch 23 which in turn causes a signal level of "0" at the terminal m of the shift register 6 which is written or loaded into the shift register 6 by the output from the terminal b of the frequency divider 2, to be written therein. Accordingly, the outputs D1 to D4 and $\overline{D1}$ to $\overline{D4}$ are turned to "0" and "1," respectively, while the output of the gate circuit 14 is kept unchanged. As the push button 25 is released, the manual switch 23 is opened and a logical value "1" is written in the shift register 6. Supposing that the output D2 changes to "1," since the subsequent output D4 is "1" at this moment, the output from the inverter 18 is turned to "1," thereby resetting the counter 5. Meanwhile, the flip-flop circuit 7 is triggered to turn its output Q to "1" so that the output from the inverter 16 is turned to "0." This causes the closure of the gate circuit 9 which then does not allow the passage of the frequency outputs from the terminals *a* and *b* of the frequency divider 2, so that the generation of the acoustic alarming signal is prevented. As a logical value "1" is written in the shift register 6, the output of the inverter 18 is turned to "0," so that the counter 5 is released from the reset condition, which starts it counting in the described manner. When the time interval of 256 seconds has passed, the acoustic alarming signal is produced again. Thus, the alarming function is performed each 256 seconds, by depressing and releaasing the push button 25 repeatedly.

For completely dismissing or terminating the alarming mode of operation, the push button 25 is depressed and then rotated in the manner as aforementioned in connection with FIGS. 2A and 2B, so as to hold the manual switch 23 at the closed condition which in turn keeps the gate circuit 10 closed thereby dismissing or terminating the alarming function.

In some cases, it becomes necessary to have the alarm work at any desired time. This is required, for example, when a dealer demonstrates the function of the timepiece to a customer, and in such a case it is inconvenient to have to keep the customer waiting for a long time of 256 seconds. To this end, the manual switch 23 is closed, after once set for suspension. As the manual switch 23 is set once for the suspension, the level output of the flip-flop circuit 7 is held at "1" and the subsequent closure of the manual switch 23 causes the output of the gate circuit 14 to turn again to "0", which in turn triggers the flip-flop circuit 7 to turn the output of the later to "0," thereby opening the gate circuit 9. Then, the alarming signal is allowed to pass through the gate circuit 9, the inverter 17 and the gate circuit 10 to the transistor 19, thereby to actuate the speaker 21.

It will be understood that the alarming function is available any time, by at first setting the manual switch 23 for the suspension of the alarming mode of operation and then closing the switch 33.

In the described second embodiment, the shift register 6 is provided mainly for removing the troubles caused by possible chattering of the manual switch 23. If it is not necessary to take this chattering into account, the logical outputs derived from the opening and closing of the manual switch 23 may be directly fed to the gate circuit 10, and an equivalent performance is obtained by substituting a differentiation circuit for the shift register 6, gate circuit 14 and the inverter 18.

Although the suspension of the alarming function has been described for an interval of 256 seconds, a longer or a shorter interval may be adopted.

As described above, this embodiment is convenient in that the structure is greatly simplified and that the alarming operation can be performed at any desired time. These advantageous features are attributable to the provision of a logical circuit operative to change output at each time of manual operation of the switch and operative to actuate the alarm by one output therefrom. This feature is especially recommendable for the dealer in demonstrating or explaining the function of the timepiece.

Figure 3:
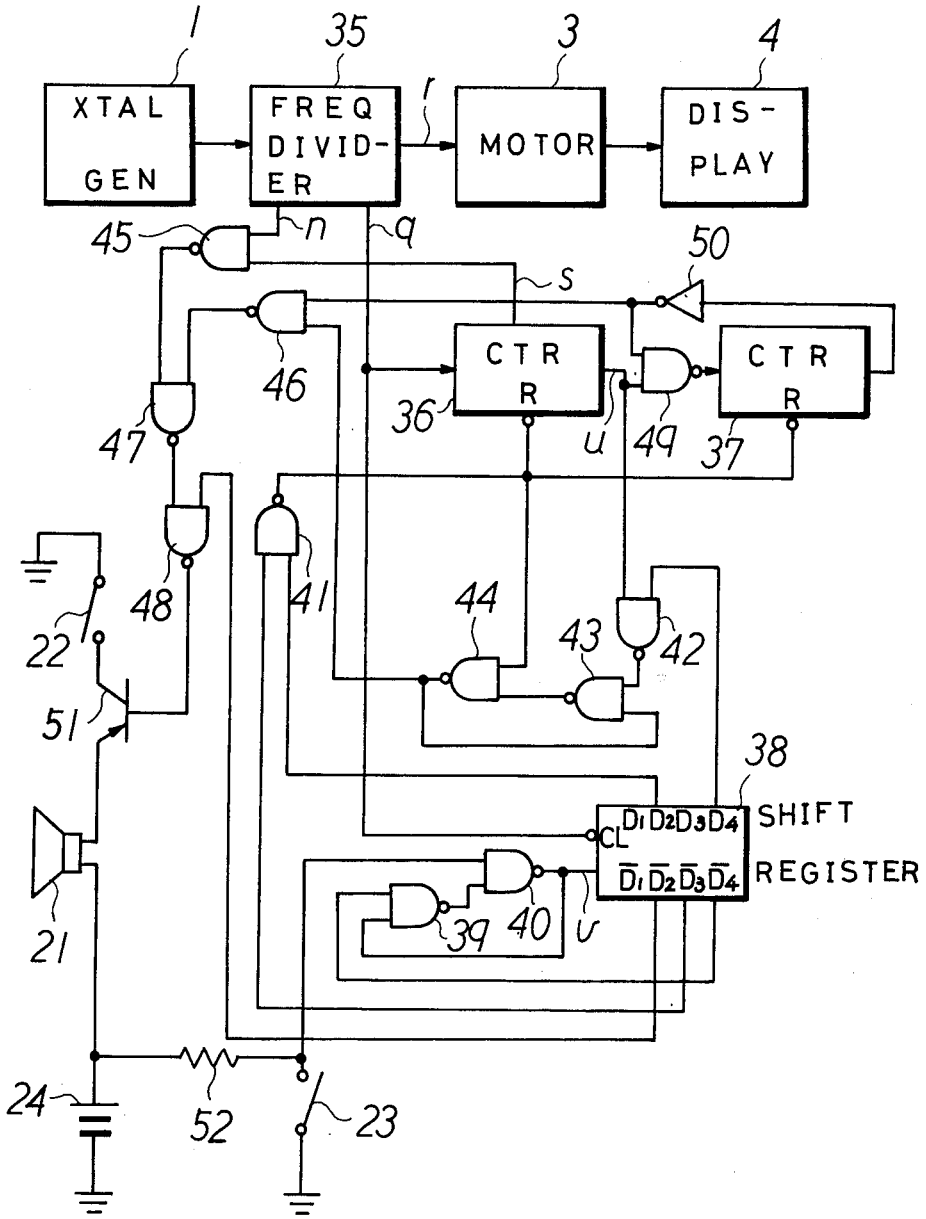
FIG. 3 shows a diagram of an electric circuit of another embodiment of the invention.

Hereinafter, an explanation will be made with respect to a third embodiment of the invention. Referring to FIG. 3, the numerals 1, 3, 4 and 21 through 24 designate, respectively, the same members as those of FIG. 1, while the numeral 35 in FIG. 3 represents the same divider as numeral 2 of FIG. 1. A first counter 36 consists of a frequency divider having the divider ratio of 1/64, and adapted to produce pulses of 4Hz and ¼Hz at the terminals *s* and *u*, respectively, while a second counter 37 consists also of a frequency divider having the divider ratio of 1/64. Reference numerals 38 and 39 through inclusive designate, respectively, a shift register and gate circuits, while numerals 50, 51 and 52 designate an inverter, a transistor and a resistance, respectively.

In operation, the time for alarming is pre-set in the circuit of FIG. 3. The manual switch 23 is normally opened and one of the inputs to the gate circuit 40 is maintained at level "1." At this moment, the level of input v of the shift register 38 is maintained at "0" which is written in the shift register by the 8Hz pulse delivered from the terminal *q* of the frequency divider 35. Accordingly, the outputs D1 to D4 are maintained "0," while the outputs $\overline{D1}$ to $\overline{D4}$ are maintained at "1." Since two inputs, one which is "0" while the other is "1," are delivered to the gate circuit 41, it maintains an output level of "1," and the first and the second counters 36 and 37 are released from the reset conditions so as to count the 8Hz pulse at the terminal *q* of the frequency divider 35. The output level "1" from the gate circuit 41 is effective to open the gate circuit 44. Since the output D4 from the shift register 38 is maintained "0," the output from the gate circuit 42 is "1" which in turn maintains an output of "0" at the gate circuit 44. Consequently, the output from the gate circuit 46 is maintained "1" to open the gate circuit 47.

The 4Hz signal delivered from the terminal s of the first counter 36 to the gate circuit 45 is effective to open and close the gate circuit 45. When the gate circuit 45 is opened, the frequency signal of several KHz generated at the terminal n of the frequency divider 35 is allowed to be passed to the gate circuit 48. Since the output D2 from the shift register 38 is "1," the gate circuit 48 is kept opened, so that the frequency signal is delivered to the transistor 51. Thus, when the time switch 22 is closed after the elapse of the pre-set time, the speaker 21 is actuated to generate an acoustic alarming signal.

For the suspension of the alarming function, this embodiment is constructed so as to produce the alarming signal each 256 seconds, when the manual switch is operated within 4 seconds. As the push button 25 is depressed, the manual switch 23 of FIG. 3 is closed to change the output from the gate circuit 40 to "1." This change causes sequential changing of outputs D1 to D4 of the shift register 38 to "1." At the time when the output D2 changes to "1," the output $\overline{D3}$ remains "1," so that the output from the gate circuit 41 changes to "0." This causes the output from the gate circuit 44 to change to "1" and also resets the counters 36 and 37. Accordingly, both of inputs to the gate circuit 46 are held at "1" and its output is "0" thereby closing the gate circuit 47 so that the alarming function is interrupted.

Since the manual switch 23 is opened again after the closure, the output from the gate circuit 40 changes to "0," which causes the outputs D1 to D4 and $\overline{D1}$ to $\overline{D4}$ to change to "0" and "1," respectively in sequence. When 256 seconds have elapsed after the reset of the counters 36 and 37, the output from the counter 37 changes to "1" thereby reversing the output from the inverter 50 to "0," which in turn causes the gate circuit 49 to close and, at the same time, causes the output from the gate 46 to become "1." Thus, the gate circuit 47 is opened to pass the alarming signal from the gate circuit 45, which signal then is passed through the gate circuit 48 to the transistor 51 thereby to actuate the speaker 21 to produce an acoustic alarming signal.

When it is required to completely dismiss or terminate the alarming function, the push button 25 is rotated after being depressed in the manner as described, so that the manual switch 23 is kept closed to hold the output from the gate circuit 40 at "1." Consequently, the output $\overline{D2}$ from the shift register 38 is maintained "0" thereby to close the gate circuit 48, so that the alarming function is completely dismissed or terminated.

In order to obtain the alarming signal at any desired time, the time switch 22 is closed and then the manual switch 23 is closed for more than 4 seconds. The manual switch 23 is then opened again. By closing the manual switch 23 for longer than 4 seconds, the output D2 of the shift register 38 acts to stop the alarming as described. On the other hand, the closure of the manual switch 23 causes the output from the gate circuit 41 to drop, so that the counters 36 and 37 are reset to enable the later to count the time. Meanwhile, the output D4 from the shift register 38 is maintained "1," so that the output from the gate circuit 42 changes to "0," when 4 seconds have been counted by the counter 36 because at that time the output from the counter 36 changes to "1." Accordingly, the output from the gate circuit 43 changes to "1" which in turn causes the output from the gate circuit 44, to which the output level of "1" is applied from the gate circuit 41, to change to "0." Consequently, the output from the gate circuit 46 changes to "1" to open the gate circuit 47. As the manual switch 23 is opened, the output $\overline{D2}$ from the shift register 38 is changed to "1" to open the gate circuit 48, so that the alarming signal is allowed to pass through the gate circuits 47 and 48 to actuate the speaker 21. Thus, the acoustic alarming signal is obtainable at any desired time.

In the described embodiment, the shift register 38 is provided mainly for removing the troubles caused by the chattering of the manual switch 23. Thus, if it is not required to take the chattering into account, the logical outputs derived from the opening and closing of the manual switch 23 can be delivered directly to the gate circuit 42 and to the gate circuit 48 upon reversing the output. The same function as that of the third embodiment is then obtainable by substituting a differentiation circuit for the gate circuit 41.

Although the described embodiment is constructed to produce an alarming signal every 256 seconds, by depressing the manual switch 23 for longer than 4 seconds, other intervals and times for depression of the manual switch 23 may be adoptable by suitably adjusting the counters 36 and 37.

What I claim is:

1. In an alarm timepiece:

a manually operable switch operable to three different settings; first means co-operative with said manually operable switch, for producing outputs respectively corresponding to a normal alarm function, a temporal suspension of the alarm function and a complete termination of the alarm function in response to first, second and third setting, respectively, of said manually operable switch; switching means operable at a pre-set time for developing a switching signal; second means reset by at least one output of the first means which is produced in response to the setting of the manually operable switch corresponding to the temporal suspension of the alarm function and which repeatedly counts a predetermined time interval when the reset condition is released; and third means responsive to the switching signal for generating an acoustic alarm when the switching means has been operated when the setting of the manually operable switch corresponds to the normal alarm, and when an output of the second means is produced when the switching means is being operated and the manually operable switch has been set to correspond to the temporal suspension of the alarm function.

2. In alarm timepiece as claimed in claim 1; further including fourth means for generating the acoustic alarm when the manually operable switch is operated after it has been set to correspond to temporal suspension of the alarm function when the switching means is being operated.

3. In alarm timepiece as claimed in claim 1; further including a counter for producing an output when it has counted a shorter time interval than said predetermined time interval; fifth means for resetting the counter when the switch has been set to correspond to the temporal suspension of the alarm function and for generating the acoustic alarm when the switch is operated and an output of the counter is produced.

4. In alarm timepiece as claimed in claim 1 in which said switch comprises:

a spring; movable means arranged for being displaced against said spring and to be returned to an initial position by said spring when released; means for limiting the displacement of said movable means to a predetermined distance; means for preventing the return of said movable means when said movable means is rotated by a predetermined angle while being displaced by said predetermined distance; and a contact means defining a contact for operating when said movable means is displaced said predetermined distance.

* * * * *